US012595720B2

(12) United States Patent
Hughes et al.

(10) Patent No.: US 12,595,720 B2
(45) Date of Patent: Apr. 7, 2026

(54) COMPOSITE PUNCHED SCREEN FOR HIGH PRESSURE APPLICATIONS

(71) Applicant: Variperm Energy Services Inc., Calgary (CA)

(72) Inventors: Matthew Hughes, Calgary (CA); Michael Ma, Calgary (CA)

(73) Assignee: Variperm Energy Services Inc., Calgary (CA)

( * ) Notice: Subject to any disclaimer, the term of this patent is extended or adjusted under 35 U.S.C. 154(b) by 0 days.

(21) Appl. No.: 18/658,817

(22) Filed: May 8, 2024

(65) Prior Publication Data

US 2024/0376805 A1 Nov. 14, 2024

Related U.S. Application Data

(60) Provisional application No. 63/500,890, filed on May 8, 2023.

(51) Int. Cl.
*E21B 43/08* (2006.01)
*B21D 39/02* (2006.01)

(52) U.S. Cl.
CPC ..... *E21B 43/084* (2013.01); *B21D 39/02* (2013.01)

(58) Field of Classification Search
CPC ..... E21B 43/084; E21B 43/086; B21D 39/02
See application file for complete search history.

(56) References Cited

U.S. PATENT DOCUMENTS

| | | | | |
|---|---|---|---|---|
| 5,918,672 | A | 7/1999 | McConnell et al. | |
| 8,146,662 | B2 * | 4/2012 | Shoemate | E21B 43/088 166/278 |
| 8,176,634 | B2 * | 5/2012 | Bonner | E21B 43/084 166/227 |
| 9,822,013 | B1 | 11/2017 | McEwan et al. | |
| 10,294,762 | B2 | 5/2019 | Greci et al. | |
| 10,781,672 | B2 * | 9/2020 | Lazo | E21B 43/084 |
| 2007/0114171 | A1 * | 5/2007 | Chen | B01D 39/12 210/489 |
| 2014/0360718 | A1 * | 12/2014 | Ma | B23K 31/02 228/101 |
| 2017/0362921 | A1 * | 12/2017 | Kim | E21B 43/082 |
| 2018/0119526 | A1 * | 5/2018 | Lopez | E21B 43/084 |
| 2022/0195858 | A1 | 6/2022 | DeBusschere et al. | |

FOREIGN PATENT DOCUMENTS

| | | | |
|---|---|---|---|
| CN | 116084908 A | * | 5/2023 |
| WO | WO 2020/005382 A1 | | 1/2020 |

* cited by examiner

*Primary Examiner* — Matthew R Buck
(74) *Attorney, Agent, or Firm* — Santosh K. Chari; CPST Intellectual Property Inc.

(57) ABSTRACT

A composite sand control screen comprises at least three coaxially arranged layers, including a punched screen layer, at least one mesh layer, and a perforated shroud layer. The layers are secured together such as by means of a swaging process.

14 Claims, 5 Drawing Sheets

COMPOSITE PUNCHED SCREEN FOR HIGH PRESSURE APPLICATIONS

CROSS REFERENCE TO PRIOR APPLICATIONS

The present application claims priority to U.S. Application No. 63/500,890, filed May 8, 2023, the contents of which are incorporated herein by reference as if set forth in its entirety.

FIELD OF THE DESCRIPTION

The present description generally relates to improved sand screens for use in hydrocarbon extraction processes from subterranean reservoirs. In one aspect, there is provided a composite screen, in particular a composite punched screen, that is adapted for tolerating high pressure conditions.

BACKGROUND

The recovery of hydrocarbons, such as oil and gas, from subterranean reservoirs comprises the drilling of wells from the surface into formations containing the hydrocarbon reservoirs. The wells may be vertical or may have an extended horizontal section. Once the wells are drilled, production tubing is then inserted therein, where such tubing provides a means of conveying the hydrocarbons to the surface. Generally, the production tubing comprises a plurality of tubular members that are secured end to end. In addition, the production tubing at least those portions positioned within or proximal to the hydrocarbon containing reservoir, is provided with a number of ports or apertures along its length to allow inflow of the hydrocarbon materials. The apertures on such tubing, referred to as the liner, may comprise slots or holes that are pre-milled on the tubing, or liner, segments.

Although the apertures on the liner segments are designed to allow ingress of hydrocarbon materials from the formation into the tubing, it is often the case that other non-desirable materials, such as sand, debris, or other particulate material contained in the formation may also be entrained in the flowing hydrocarbons and enter the production tubing through the apertures. Such particulate materials not only reduce the production efficiency of the extraction process but may also lead to physical damage of the tubing and other equipment. To mitigate against the entrance of such particulate material, it is common for liners to be provided with a filtering means to inhibit inflow of particulate materials.

The filtering means may comprise a screen that covers the outer surface of the perforated liner segment. The openings of the screen can be adjusted to filter out sand etc., with the size of the openings being tailored to suit the characteristics of the formation. One example of such filtering means is a wire wrap screen, which comprises helically wound wire and axially extending support rods provided over a perforated pipe segment, or base pipe. Another example is a punched screen, which comprises a perforated base pipe over which a tubular component, or jacket, is placed. The jacket comprises a tubular member that is "punched" or indented to create a plurality of openings along its length. An example of a punched screen is the proPUNCH® sand control device manufactured by Variperm Energy Services Inc.

It is also common for the aforementioned screens to be further provided with a cylindrical shroud over the filtering means to protect the filtering means from physical damage during installation or the tubing string. U.S. Pat. No. 8,146,662, for example, teaches a wire wrap screen provided on a base pipe, with the screen further comprising an outer mesh layer, for filtering particulate matter, and further protective outer shroud layer, over the mesh layer, comprising a perforated tubing. The screen is made by first winding the wires about a base pipe, covering the wires with the mesh, providing the shroud over the mesh, and finally crimping the ends of the shroud. This forces the shroud, mesh, and wire wrap against the base pipe. The ends of the shroud structure are then welded against the base pipe. The shroud taught in this reference is only connected to the underlying layers at its ends, with such connection being accomplished once the screen layers are provided over the base pipe.

U.S. Pat. No. 10,781,672 teaches a sand control screen comprising a base pipe, a drainage layer (such as a wire wrap screen or slotted screen) provided over the base pipe, a filter medium (such as a woven material, a wire wrap, or slotted screen) provided over the drainage layer, and a protective shroud provided over the filter medium, where the shroud is provided to prevent physical damage during the installation of the tubing into the well. The shroud of this reference is specifically designed to be radially spaced away from the underlying filter layer of the screen to permit fluids from freely flowing there-between.

U.S. Pat. No. 8,176,634 teaches another screen comprising an outer shroud that is designed for protecting the underlying screen structure from damage during the installation process. The shroud of this reference is also only secured to the underlying layers at its ends and, as with U.S. Pat. No. 10,781,672, is spaced apart from the immediately underlying layer to allow fluids to flow freely.

While the known screen assemblies often include protective outer shrouds, such shrouds are designed solely for the purpose of preventing physical damage caused by abrasion etc. during the installation of the tubing into the well. However, the present inventors have identified a need for a shroud that also protects the underlying screen from damage resulting from high pressure differentials across the screen as may be encountered during installation and in production operations.

SUMMARY OF THE DESCRIPTION

In one embodiment, there is provided a composite sand control screen comprising: a generally cylindrical punched screen, having a plurality of louvers; a mesh layer provided over the punched screen; a perforated shroud provided over the mesh layer; and, first and second end rings, wherein the first end ring is secured to a first end of the sand control screen and the second end ring is secured to an opposite second end of the sand control screen; wherein the punched screen, the mesh layer, and the perforated shroud are generally coaxially arranged to form a generally cylindrical structure.

In another aspect, there is provided a method of forming a composite sand control screen, the method comprising: providing a cylindrical punched screen; wrapping the punched screen with a mesh layer; providing a cylindrical shroud over the wrapped punched screen; and roll forming the shroud over the punched screen and mesh.

A sand screen apparatus is also provided, comprising one or more base pipe segments and a composite screen as described herein.

BRIEF DESCRIPTION OF THE FIGS

The features of certain embodiments will become more apparent in the following detailed description in which reference is made to the appended figures wherein.

DETAILED DESCRIPTION

Figure 1:
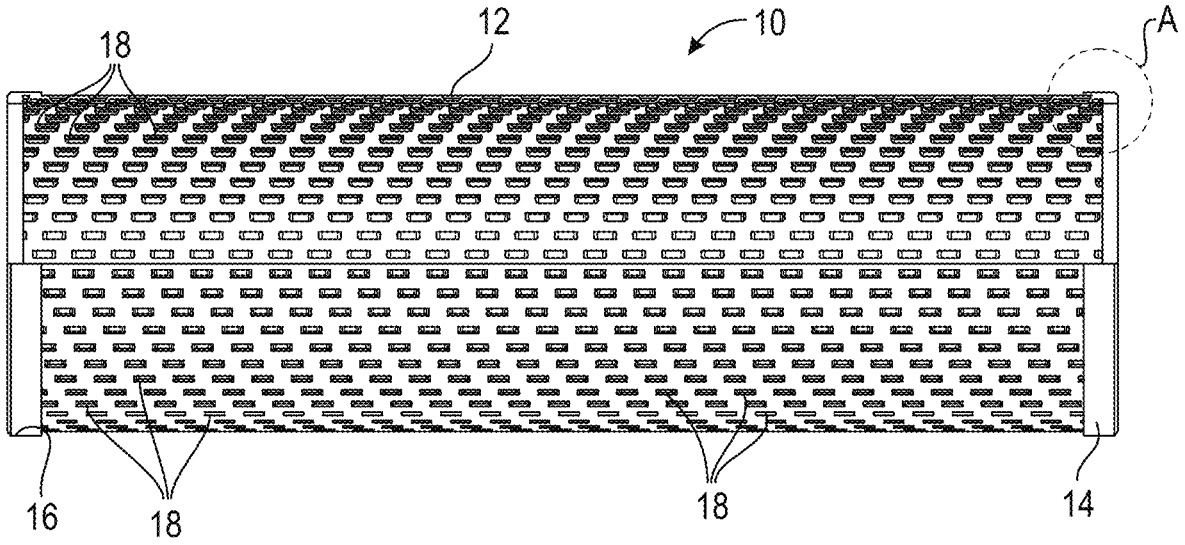
FIG. 1 (Prior Art)
FIG. 1 is a side view and partial cross-sectional view of a known punched screen.

As used herein, the terms "sand", "particles", "particulates", and "particulate material" will be understood to mean any unconsolidated particles found or introduced into subterranean reservoirs and is ultimately entrained in subsurface fluids.

The term "hydrocarbons" refers to hydrocarbon compounds that are found in subterranean reservoirs. Examples of hydrocarbons include oil and gas. For the purposes of the present description, the desired hydrocarbon component is primarily oil, such as heavy oil.

The term "well" or "wellbore" refers to a bore drilled into a subterranean formation, such as a formation containing hydrocarbons. A well may comprise one or more sections that are vertical, horizontal, or between vertical and horizontal, with respect to the surface of the earth.

The term "wellbore fluids" refers to hydrocarbons and other materials contained in a reservoir that are capable of entering into a wellbore. The present description is not limited to any particular wellbore fluid(s). It will be understood that wellbore fluids may contain sand or other such particulate material from the wellbore.

The terms "pipe" or "base pipe" refer to a section of pipe, or other such tubular member. For the purposes of the present description, a base pipe is generally provided with one or more ports or slots along its length to allow for flow of fluids there-through.

The term "production" refers to the process of producing wellbore fluids, in particular, the process of conveying wellbore fluids from a reservoir to the surface.

The term "production tubing" refers to a series of pipe segments, or tubulars, connected together and extending through a wellbore from the surface into the reservoir. Production tubing serves as a conduit for the production process. It will be understood that production tubing will include a plurality of apertures along at least one or more sections, with such apertures adapted to receive wellbore fluids from the subterranean reservoir.

The terms "screen", "sand screen", "wire screen", or "wire-wrap screen", as used herein, refer to known filtering or screening devices that are used to inhibit or prevent sand or other solid material from the reservoir from flowing into the pipe. As known in the art, such screens comprise openings that are generally smaller in size than the apertures provided on production tubing and serve to filter particular material of a given size dimension.

In the present description, the terms "top", "bottom", "front" and "rear" may be used. It will be understood that the use of such terms is purely for the purpose of facilitating the description of the embodiments described herein. These terms are not intended to limit the orientation or placement of the described elements or structures in any way.

The terms "comprise", "comprises", "comprised" or "comprising" may be used in the present description. As used herein (including the specification and/or the claims), and unless stated otherwise, these terms are to be interpreted as open-ended terms and as specifying the presence or inclusion of the stated features, integers, steps or components, but not as precluding or excluding the presence of one or more other feature, integer, step, component or a group thereof as would be apparent to persons having ordinary skill in the relevant art. Thus, the term "comprising" as used in this specification means "consisting at least in part of". When interpreting statements in this specification that include that term, the features, prefaced by that term in each statement, all need to be present but other features may also be present. Related terms such as "comprise" and "comprised" are to be interpreted in the same manner.

The phrases "consisting of", "consisting essentially of", or "consists essentially of" will be understood as generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open-ended term, such as "comprising" or "including", it will be understood that direct support should be afforded also to "consisting essentially of" language as well as "consisting of" language as if stated explicitly and vice versa. In essence, use of one of these terms in the specification provides support for all of the others.

For the purposes of the present specification and/or claims, and unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth herein are approximations that may vary depending upon the desired properties sought to be obtained by the present invention, inclusive of the stated value and has the meaning including the degree of error associated with measurement of the particular quantity. The term "about" generally refers to a range of numbers that one of ordinary skill in the art would consider as a reasonable amount of deviation to the recited numeric values (i.e., having the equivalent function or result). For example, the term "about" as used herein can be construed as including a deviation of ±10 percent of the given numeric value provided such a deviation does not alter the end function or result of the value. Therefore, a value of about 1% can be construed to be a range from 0.9% to 1.1%.

The term "and/or" can mean "and" or "or".

Unless stated otherwise herein, the articles "a" and "the", when used to identify an element, are not intended to constitute a limitation of just one and will, instead, be understood to mean "at least one" or "one or more".

In the present description, reference is made to a "composite punched screen" or to a "composite punched screen assembly". These terms are intended to be synonymous and to refer to a screen having multiple layers. In one embodiment, as described herein, the layers or the assembly are secured together to form an essentially integrated cylindrical screen structure.

Figure 2:
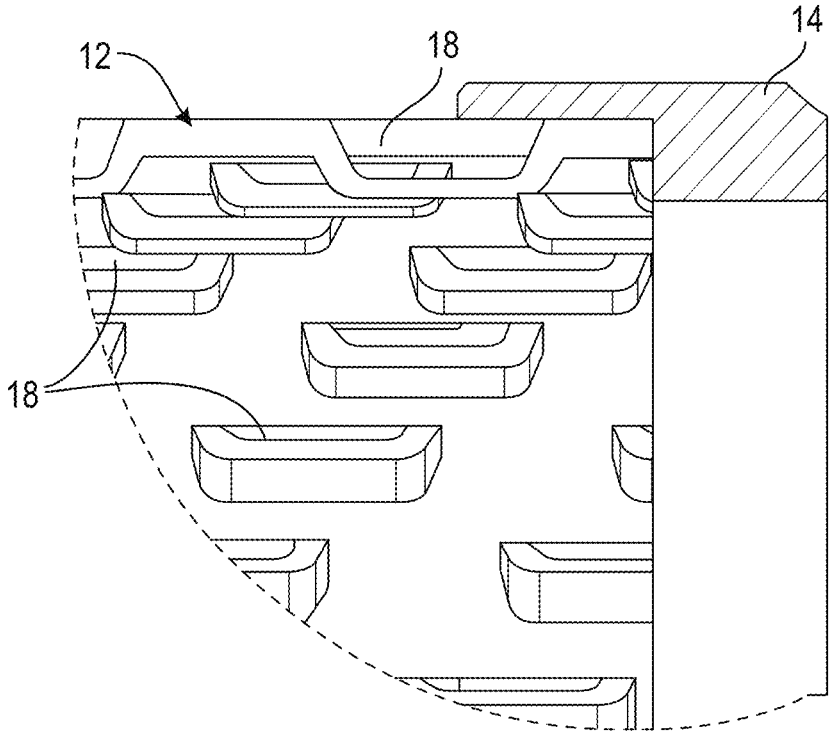
FIG. 2 (Prior Art)
FIG. 2 is a cross-sectional view of section "A" of FIG. 1.

FIGS. 1 and 2 schematically illustrate a known punched screen 10 that is used for filtering particulate material from wellbore fluids. The illustrations in FIGS. 1 and 2 are not intended to limit the description to any sizes or proportions of the illustrated features. The screen 10 comprises a generally cylindrical body 12 made of a punched screen. The screen body 12 is secured to first and second end rings 14 and 16, respectively, each of which is provided on an opposite end of the screen body 12 as shown in FIG. 1. The end rings 14, 16 may be secured by welding to the ends of the screen body 12. End rings such as those shown are known in the art and serve to retain the shape of the screen 10 and to facilitate installation of the screen on a base pipe (as discussed further below).

The punched screen body 12 may be made from a flat elongate metal sheet that is subjected to a punching operation to form openings, or louvers 18 as shown. As shown, and as known in the art, the louvers 18 comprise inwardly extending portions. Any known method of forming may be used to form the louvers 18. The formed sheet is then helically formed into a cylindrical shape as shown using any known methods.

In use, and as known in the art, the punched screen 10 is slipped over the surface of a perforated base pipe (not shown) and secured thereto by welding the support rings 14 and 16 to the outer surface of the base pipe. As would be understood, the punched screen 10 may be of any length and of any diameter, limited only by the structural characteristics of the base pipe to which it is to be attached. In one aspect, and as known the art, the inner diameter of the punch screen 10 may be greater than the outer diameter of the base pipe, thereby resulting in an annular space therebetween. In this way, fluids passing through the screen 10 flow into the annular space and subsequently into the perforations of the base pipe. Such annular space may be formed as a result of the inner diameters of the end rings 14 and 16 being smaller than the inner diameter of the punch screen body 12. It will, however, be understood that the inner diameters of the end rings 14, 16 will be sized to allow installation of the screen 10 over the base pipe.

Figure 3:
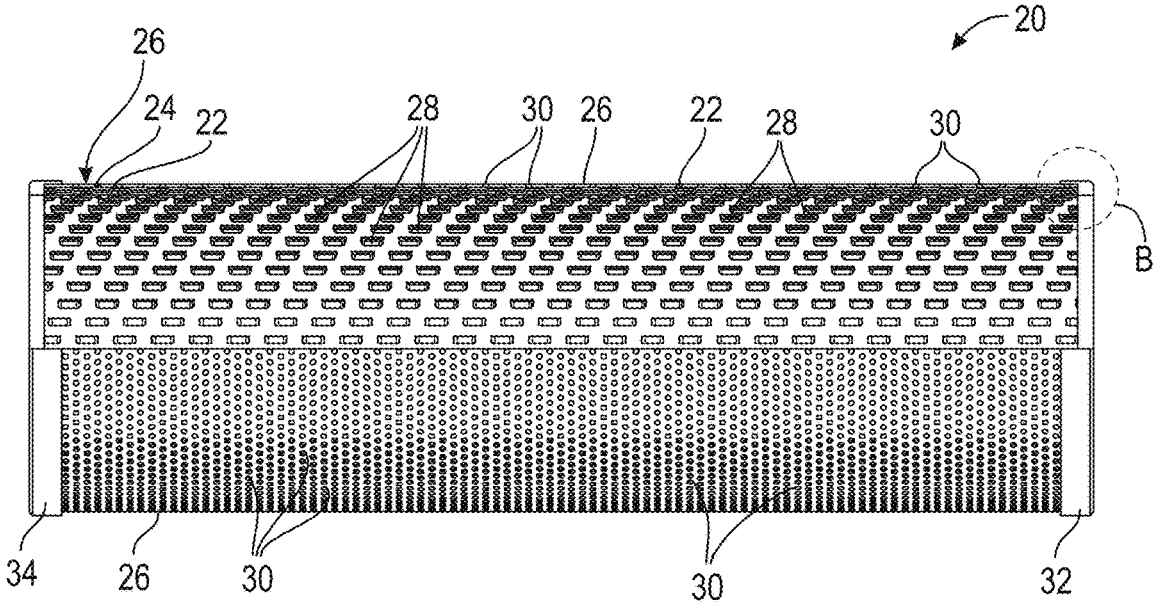
FIG. 3 is a side view and partial cross-sectional view of a composite punched screen according to an embodiment of the present description.
Figure 4:
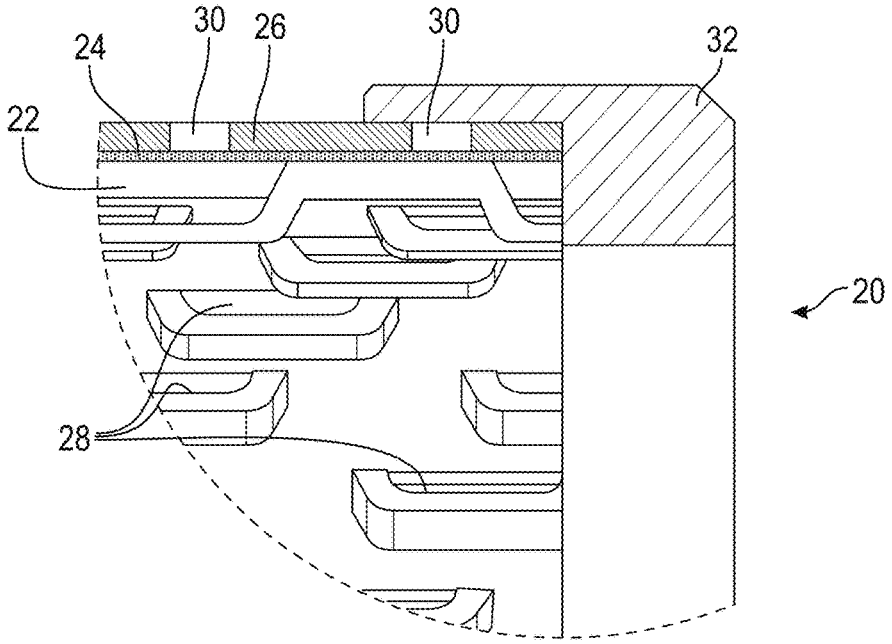
FIG. 4 is a cross-sectional view of section "B" of FIG. 3.

FIGS. 3 and 4 schematically illustrate a composite punched screen 20 according to an embodiment of the present description. The illustrations in FIGS. 3 and 4 are not intended to limit the description to any sizes or proportions of the illustrated features. As shown, the composite punched screen 20 has a generally coaxially layered cylindrical structure, the inner layer of which comprises a punched screen 22 that may be of a similar construction as punched screen 12 described above, having openings or louvers 28 formed by a punching method. The louvers 28 may be formed on the screen 22 by a punching operation as described above, or any other known method. The punched screen 22 serves to provide the required sand control (i.e., particulate filtration) function of the composite punched screen 20.

The composite punched screen 20 further comprises at least one mesh screen 24 provided coaxially over the surface of the punched screen 22. The mesh screen 24 that may comprise one or more layers of any known mesh-like metal material. It will be understood that also the term "mesh screen" is used in the singular, such screen may be formed of one or more layers of the mesh material. In one embodiment the material forming the mesh screen 24 may be a steel (such as stainless steel) mesh or a woven metal wire material. As with known mesh or mesh-like materials, the mesh screen will have a porosity, namely openings that allow passage of material there-through. The openings of the mesh screen 24 may have a size (e.g., diameter) that is the same, larger, or smaller than that of the louvers of the punched screen 22. In one aspect, the mesh screen 24 is provided with openings that are larger than the openings in the louvers of the punched screen 22. In such case, particulate material of a given size may be small enough in at least one dimension to pass through the mesh screen 24 but too large to pass through the apertures of the punched screen 22.

The composite punched screen 20 additionally comprises an outer layer comprising a protective shroud 26. The shroud 26 generally comprises a cylindrical sheath coaxially overlying the mesh screen 24. As shown, the shroud 26 is provided with a plurality of pre-milled perforations or apertures 30 over its surface. In one aspect, the apertures 30 may comprise circular openings, although the description is not limited to any particular shape of the apertures 30. As with the punch screen 22, the shroud 26 may be formed from an elongate flat metal sheet, that is provided with the apertures 30 and then helically wound to form a cylindrical structure. Methods of forming such helical structures from a sheet are known in the art. As discussed further below, the apertures 30 of the shroud 26 are preferably of a larger size than the openings of the mesh screen 24. Thus, in one aspect, the shroud 26 offers little to no hindrance to the passage of fluids across its surface.

As also illustrated in FIGS. 3 and 4, the composite screen 20 of the description is secured to first and second end rings 32 and 34, respectively, each of which is provided on an opposite end of the layers 22, 24, 26 forming the composite screen 20. In one aspect, the end rings may be welded to the layered structure as described above. End rings 32 and 34 provide the same function as described above, namely, to retain the cylindrical shape of the composite screen 20 and to facilitate its installation over a base pipe.

In one embodiment of the present description, the layers 22, 24, 26 of the composite screen 20 are secured to each other over at least a portion of the respective contact surfaces. In one embodiment, each of the punch screen 22 and the shroud 26 are attached to the intervening mesh layer 24 over the entirety of the respective contact surfaces.

Figure 5:
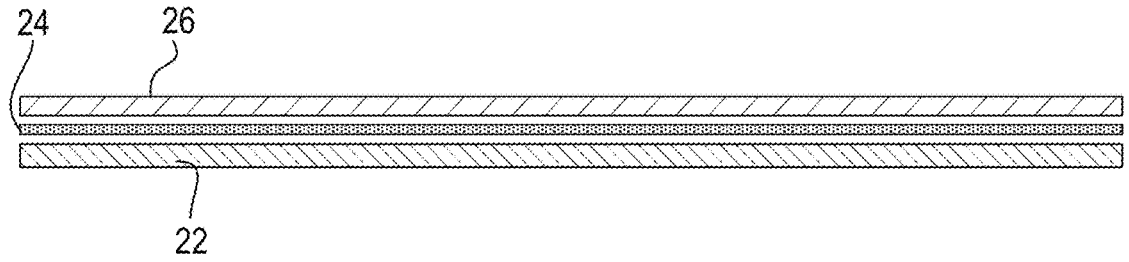
FIG. 5 is a schematic cross-sectional view of the layers of the composite punched screen prior to swaging.
Figure 6:
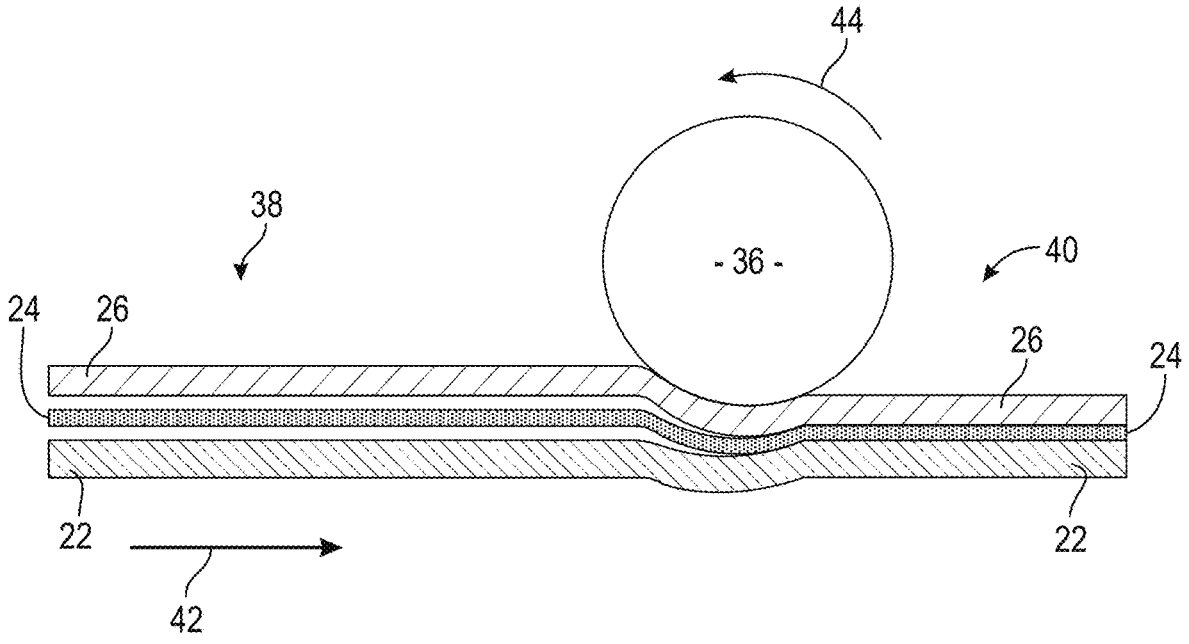
FIG. 6 is a schematic cross-sectional view of the layers of the composite punched screen being formed by a swaging operation.

In one embodiment, the layers 22, 24, and 26 of the composite screen 20 are secured to each other by means of a swaging operation as illustrated schematically in FIGS. 5 and 6. In such operation, the layers are first coaxially assembled as illustrated in FIG. 5. In particular, the process involves providing cylindrical punch screen 22. As discussed above, the punch screen 22 may be made using any known methods. The punch screen 22 is then wrapped, or provided with, a mesh layer 24 over its outer surface. Thereafter, the shroud layer 26, is slid over the punch screen 22 wrapped with the mesh layer 24. As will be understood, punch screen layer 22, wrapped with the mesh layer 24, and the shroud 26 are cylindrical structures; however, such cylindrical structures are not shown in FIGS. 5 and 6, which are intended to only illustrate the arrangement of such layers. Furthermore, it will also be understood that, for convenience, FIGS. 5 and 6 do not illustrate the louvers 28 of the punch screen 22 or the perforations 30 of shroud 26.

Once the screen components, or layers, are assembled as shown in FIG. 5, the coaxial assembly is then subjected to a swaging, or roll forming process as shown in FIG. 6. In one embodiment, the coaxially arranged layers 22, 24, and 24, as shown at 38, is moved in the direction of the arrow 42 and passed through rollers 36 rotating in a direction shown by arrow 44, which apply a radially inward compression force on the shroud layer 26. Such roll forming processes are known in the art. For example, as would be known to persons skilled in the art, a typical roll forming apparatus would comprise four rollers 36, which apply a compressive force on two planes to thereby evenly apply a radially compressive force.

As illustrated in FIG. 6, the roll forming process radially compresses the outer shroud layer 26 thereby permanently deforming same by reduction of its outer diameter. Such deformation also results in reduction of the inner diameter of the shroud layer 26, thereby resulting in the shroud layer 26 and mesh layer 24 being pressed against the punched screen layer 22. As also illustrated in FIG. 6, once the layered structure passes through the rollers 36, and the radially compressive force removed, the punched screen layer 22, reverts to its original outer diameter. Thus, in view of the permanent deformation of the shroud layer 26, the mesh layer 24, having a lower density as compared to the punch screen and shroud, is compressed between the two adjacent layers. The roll forming process may be controlled by measuring the radially inward deflection of the punch screen 22. In particular, the force applied by the rollers 36 can be calibrated by measuring the change in diameter of the punch screen and allowing the rollers to only apply a force necessary to deform the shroud 26 but that is within the elastic deformation limit of the punch screen. It will, however, be appreciated that the rollers may be calibrated to apply a force exceeding the elastic deformation limit of the punch screen 22 where it is desired to reduce the inner diameter of the punch screen 22 layer, and thereby that of the composite screen 20.

In the swaging, or roll forming, process as described above, the material of the mesh layer 24 is extruded into the openings or louvers 28 of the punch screen 22 and into the perforations 30 of the shroud 26. As a result, the mesh layer 24 serves to mechanically secure or lock the coaxial layers 22 and 26 together to limit or prevent relative movement of the punched screen 22 and the shroud 26, thereby essentially forming a unitary cylindrical composite structure. In one embodiment, the punched screen 22 and shroud 26 are limited or prevented from relative axial movement (i.e., movement along the common axis) and preferably also from relative radial movement (whereby radial separation of the punched screen 22 from the shroud 26 is limited or prevented). Once such composite structure is formed, the end rings and 34 described above are secured to the opposite ends thereof to result in the composite punched screen 20.

Figure 7:
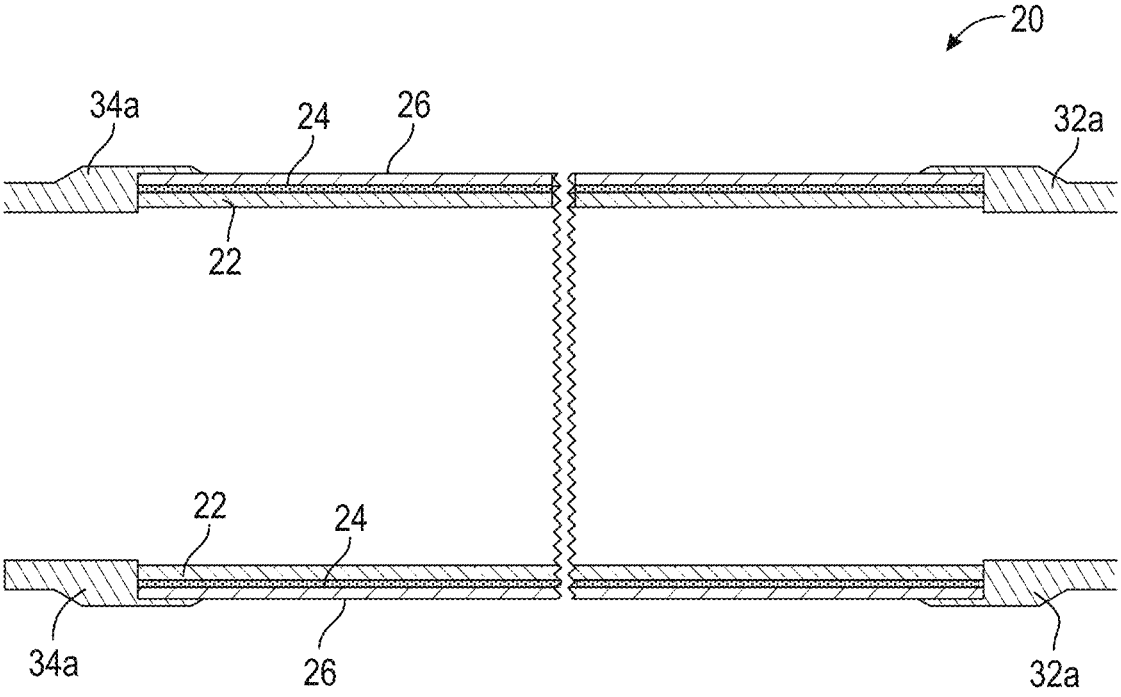
FIG. 7 is a longitudinal cross-sectional view of a composite punched screen according to an embodiment of the description without a base pipe.

FIG. 7 illustrates a formed composite punched screen 20 according to another aspect, where like elements to those described above are identified with like reference numerals. As shown, the composite screen 20 has the same structure as described above but with end rings 32*a* and 34*a* that are similar in structure and function to those described above. For convenience of illustration, the louvers 28 and perforations 30 are not shown in FIG. 7.

Figure 8:
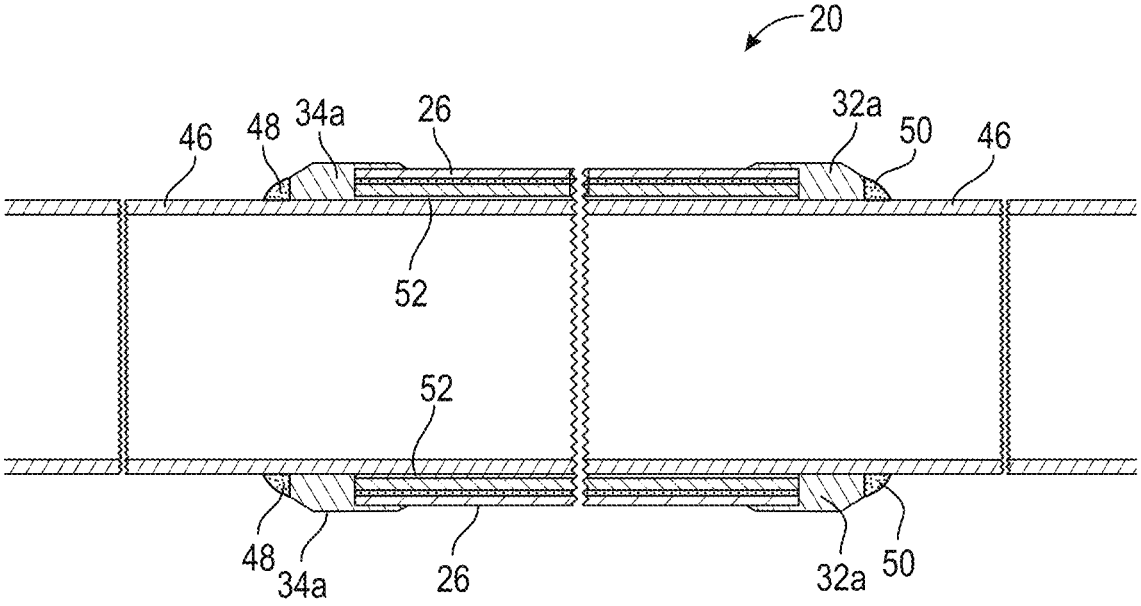
FIG. 8 is a longitudinal cross-sectional view of the composite punched screen of FIG. 7 installed on a base pipe.

FIG. 8 illustrates the composite punched screen 20 of FIG. 7 after being installed on a base pipe 46. As shown, after sliding the composite punched screen 20 onto the base pipe 46, the screen is secured in position by means of welds 48 and 50, which connect the end rings 34*a* and 32*a*, respectively, to the base pipe 46. As would be known to persons skilled in the art, the base pipe 46 would typically include a plurality of ports or openings therethrough to allow fluid to flow into its lumen. For convenience of illustration, such openings or ports of the base pipe are not shown in FIG. 8.

FIGS. 7 and 8 also illustrate an embodiment wherein the inner diameters of the end rings 32 and 34 are smaller than that of remainder of the composite screen 20. In this way, and as described above, an annular space 52 is formed between the body of the composite screen 20 and the outer surface of the base pipe 46 to allow flow of fluids.

As would be appreciated by persons skilled in the art, the swaging process described above may be preferred in view of the fact that, as illustrated in FIG. 4, for example, the louvers 28 of the punch screen extend radially inwardly. Accordingly, a radially compressive force applied on the outer diameter of the punch screen would not deform the pre-milled louvers. Thus, the aforementioned roll forming process may be preferred over a process involving outward radial expansion of the punch screen layer 22. Specifically, with the latter, the force required to outwardly expand the punch screen 22 would necessarily result in deformation or collapse of the radially inwardly extending louvers 28 of the punch screen 22, thereby occluding the openings in the screen 22 and inhibiting the desired sand screen function.

Similarly, another feature of the composite punched screen 20 described herein is that the swaging or roll forming operation is performed prior to installing the screen on a base pipe. In particular, and for the reasons described above, if a radially compressive were applied on the layered screen structure after installation on a base pipe, the resistive force applied by the base pipe would deform the louvers 28 thereby inhibiting the required screening function.

The composite screens described herein may be used with any size of base pipe and in any type of well where sand control is required.

In the above discussion, the composite screen has been described as being provided over a perforated base pipe. It will, however, be understood that the base pipe may also include another sand control device (such as a wire wrap screen or other known device), over which the presently described composite screen may be provided.

Figure 9:
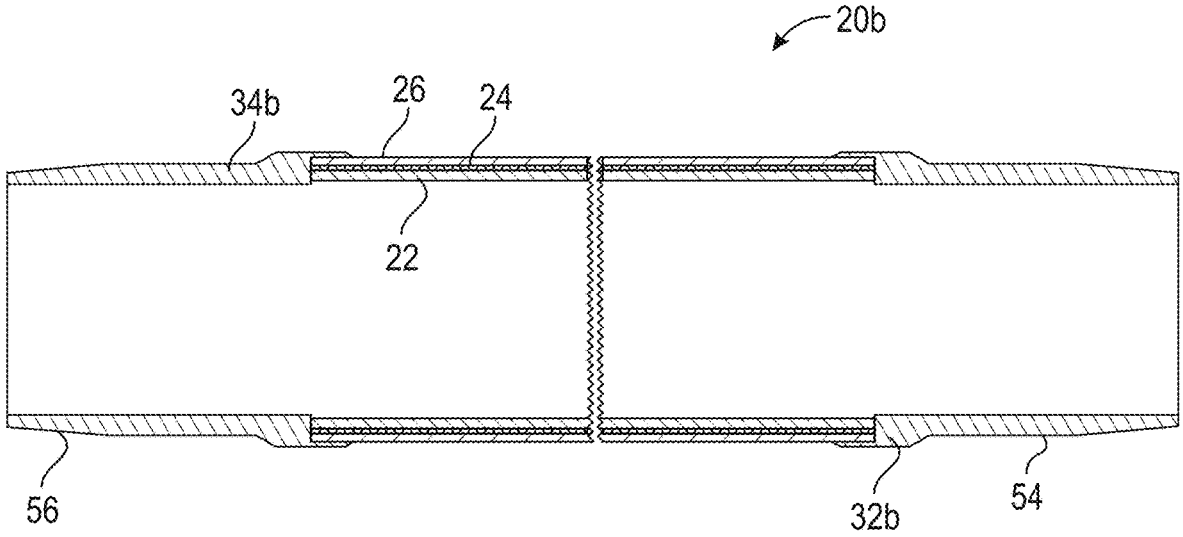

A further embodiment of the description is illustrated in FIG. 9, where like elements are illustrated with like reference numerals but with a suffix "b" to identify different embodiments. As shown, the composite screen 20*b* is similar in structure to the previously described composite screen. However, the end rings 32*b* and 34*b* are elongated, as shown. In this aspect, the composite screen 20*b* is adapted for installation in line with other tubular members so as to be integral with a tubing that is installed downhole. As will be understood, for this purpose, the opposed ends 54 and 56 of the end rings 32*b* and 34*b*, respectively, may be provided with threaded outer surfaces to allow the composite screen 20*b* to be attached to adjacent tubular members. Alternatively, the opposed ends 54 and 56 may be provided with internal threads, or one end may be provided with an external thread and the other with an internal thread, to achieve the same purpose. As would be understood, the embodiment of the screen as shown in FIG. 9, and as described above, would not be provided over a base pipe segment. Accordingly, this embodiment may be used for other well operations such as for dewatering or applications in vertical instead of horizontal wells. The end rings 32*b* and 34*b* may be secured to the screen portions, i.e., 22, 24, and 26, in the same manner as described above.

As would be appreciated by persons skilled in the art, the composite punched screen of the present description offers several advantages. Primarily, the composite screen described herein exhibits higher mechanical strength over separated owing to its unitary, layered cylindrical structure. In particular, and as described above, following the swaging process, the mesh layer 24 binds, or mechanically locks the punch screen layer 22 to the shroud 26, thereby preventing relative movement between the punch screen layer 22 and the shroud either in the axial or radial directions. Accordingly, the composite screen described herein offers improved strength over commonly known punch screens. In particular, in testing conducted by the inventors, the composite screens described herein were found to be much more resistant to stresses that would otherwise lead to collapse, bending, and/or bursting of the screen as compared to commonly known punch screens alone or commonly known wire wrap screens.

Although the above description includes reference to certain specific embodiments, various modifications thereof will be apparent to those skilled in the art. Any examples provided herein are included solely for the purpose of illustration and are not intended to be limiting in any way. Any drawings provided herein are solely for the purpose of illustrating various aspects of the description and are not intended to be drawn to scale or to be limiting in any way. The scope of the claims appended hereto should not be limited by the preferred embodiments set forth in the above description but should be given the broadest interpretation consistent with the present specification as a whole. The disclosures of all prior art recited herein are incorporated herein by reference in their entirety.

We claim:

1. A composite sand control screen comprising:

a generally cylindrical punched screen, having a plurality of louvers;

a mesh layer provided over the punched screen;

a perforated shroud provided over the mesh layer; and, first and second end rings, wherein the first end ring is secured to a first end of the sand control screen and the second end ring is secured to an opposite second end of the sand control screen;

wherein the punched screen, the mesh layer, and the perforated shroud are generally coaxially arranged to form a generally cylindrical structure;

and wherein the shroud, the punched screen, and the mesh layer are swaged together.

2. The composite sand control screen of claim 1, wherein the swaging results in the mesh layer being mechanically adhered to the punched screen and to the shroud.

3. The composite sand control screen of claim 1, wherein the swaging results in the mesh layer being embedded within the louvers of the punched screen and within the perforations of the shroud.

4. The composite sand control screen of claim 1, wherein the mesh layer comprises one or more layers of metal mesh wrapping.

5. The composite sand control screen of claim 1, wherein the first and second end rings are welded to at least one of the shroud and the punched screen.

6. The composite sand control screen of claim 1, wherein the sand control screen is adapted to be provided over an outer surface of a base pipe.

7. The composite sand control screen of claim 6, wherein the first and second end rings are adapted to be welded to the base pipe.

8. The composite sand control screen of claim 1, wherein the sand control screen is adapted to be axially attached to adjacent base pipe segments to form a continuous tubular structure.

9. The composite sand control screen of claim 8, wherein the first and second end rings are adapted to be connected to respective ends of the adjacent base pipe segments.

10. A sand screen apparatus comprising:

a base pipe segment, the base pipe segment comprising a cylindrical body having a plurality of apertures therethrough; and, a composite sand screen according to claim 1 provided over an exterior of the base pipe segment, wherein the first and second end rings are secured to an outer surface of the base pipe segment.

11. A sand screen apparatus comprising:

first and second base pipe segments, the base pipe segments comprising cylindrical bodies arranged end to end, whereby a first end of a first base pipe segment is provided facing a first end of a second base pipe segment; and, a composite sand screen according to claim 9 provided coaxially between the first and second base pipe segments, wherein the first end ring is secured to the first end of the first base pipe segment and the second end ring is secured to the first end of the second base pipe segment.

12. A method of forming a composite sand control screen, the sand control screen being adapted to be installed over a base pipe, the method comprising:

providing a cylindrical punched screen separate from the base pipe and having an inner diameter larger than an outer diameter of the base pipe;

wrapping the punched screen with a mesh layer;

providing a cylindrical shroud over the wrapped punched screen; and swaging together the shroud, the punched screen, and the mesh layer to form the composite sand control screen; and providing the composite sand control screen over the base pipe.

13. The method of claim 12 further comprising attaching a first end ring to a first end of the composite sand screen and attaching a second end ring to an opposite second end of the sand screen prior to providing the composite sand control screen over the base pipe.

14. The method of claim 12, wherein the step of wrapping the punched screen comprises wrapping with one or more mesh layers.

* * * * *